US009227768B2

(12) United States Patent
Quick et al.

(10) Patent No.: US 9,227,768 B2
(45) Date of Patent: Jan. 5, 2016

(54) SECURABLE CONSUMER GOODS TRANSPORTATION APPARATUS

(75) Inventors: Eric S Quick, San Ramon, CA (US); Yvonne Steiner, Citrus Heights, CA (US); Jeffrey Shamburger, Dublin, CA (US)

(73) Assignee: SAFEWAY, INC., Pleasanton, CA (US)

( * ) Notice: Subject to any disclaimer, the term of this patent is extended or adjusted under 35 U.S.C. 154(b) by 2086 days.

(21) Appl. No.: 11/861,139

(22) Filed: Sep. 25, 2007

(65) Prior Publication Data

US 2009/0078713 A1 Mar. 26, 2009

(51) Int. Cl.
*B65D 33/14* (2006.01)

(52) U.S. Cl.
CPC ..... *B65D 33/14* (2013.01)

(58) Field of Classification Search
USPC ..... 224/275
See application file for complete search history.

(56) References Cited

U.S. PATENT DOCUMENTS

| | | | | |
|---|---|---|---|---|
| D69,940 | S | 4/1926 | Fishbein | |
| D248,059 | S | 5/1978 | Darrell | |
| D248,060 | S | 5/1978 | Darrell | |
| 4,442,960 | A * | 4/1984 | Vetter | B62J 9/00 190/108 |
| D273,877 | S | 5/1984 | Darrell | |
| 4,733,808 | A * | 3/1988 | Turner, Jr. | A01M 31/004 224/219 |
| D375,676 | S | 11/1996 | Davis et al. | |
| D379,869 | S | 6/1997 | Formby | |
| 6,045,019 | A * | 4/2000 | Moses | 224/257 |
| 6,296,165 | B1 * | 10/2001 | Mears | 224/610 |
| D459,399 | S | 6/2002 | Phillips | |
| D465,528 | S | 11/2002 | Pfannenberg | |
| D471,205 | S | 3/2003 | Lane | |
| D486,186 | S | 2/2004 | da Silva | |
| D491,354 | S | 6/2004 | Chapelier | |
| 6,818,271 | B2 | 11/2004 | Fearn et al. | |
| 6,932,214 | B1 * | 8/2005 | Zimet | B60R 7/043 206/217 |
| D530,081 | S * | 10/2006 | Moon | D3/232 |
| D530,510 | S | 10/2006 | Suppancig | |
| 7,309,102 | B1 * | 12/2007 | Davis | 297/188.06 |
| D566,777 | S | 4/2008 | Delmotte et al. | |
| D583,666 | S | 12/2008 | Coin | |
| 2003/0160076 | A1 * | 8/2003 | Lofaro | 224/275 |
| 2003/0184103 | A1 * | 10/2003 | Cauchy | 294/27.1 |
| 2004/0084489 | A1 * | 5/2004 | Murphey | A45F 5/00 224/221 |
| 2006/0011686 | A1 * | 1/2006 | Latham | 224/579 |
| 2006/0266776 | A1 * | 11/2006 | Plakke | A45F 5/02 224/222 |
| 2007/0131568 | A1 * | 6/2007 | Georgia et al. | 206/223 |
| 2009/0050505 | A1 | 2/2009 | Rubin | |

* cited by examiner

*Primary Examiner* — Adam Waggenspack
(74) *Attorney, Agent, or Firm* — Conley Rose, P.C.; Rodney B. Carroll

(57) ABSTRACT

A securable consumer goods transportation apparatus comprising a container, and a spill prevention strap attached to the container. Also disclosed is a method comprising placing a consumer good in a container comprising a spill retention strap, positioning the container in a vehicle, securing the container in the vehicle using the spill retention strap, wherein the spill retention strap substantially maintains the position of the container relative to the vehicle when the vehicle experiences a substantially sudden movement. Furthermore, a method comprising providing instructions to secure a container comprising a spill retention strap in a vehicle, wherein the spill retention strap substantially maintains the position of the container relative to the vehicle when the vehicle experiences a substantially sudden movement is disclosed.

20 Claims, 15 Drawing Sheets

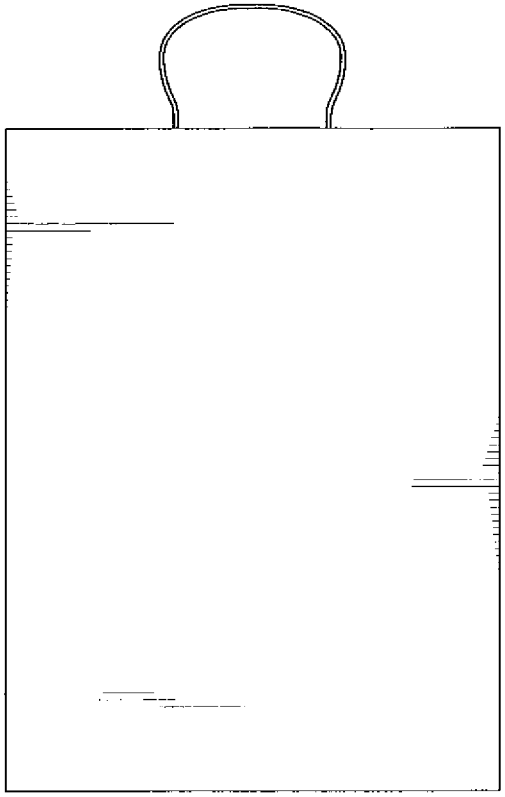
FIG. 17
FIG. 18
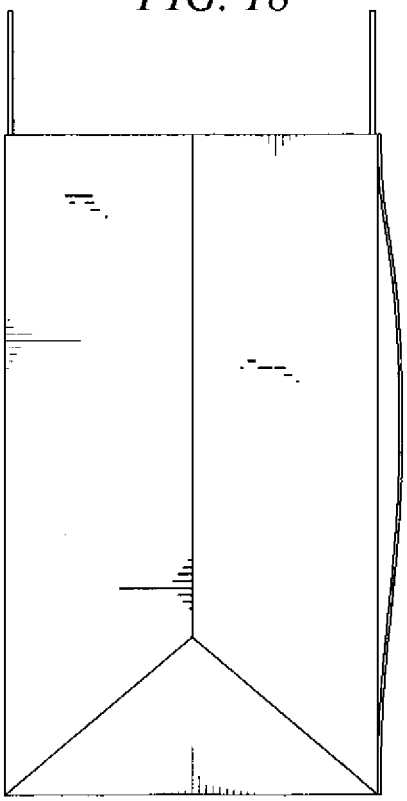
FIG. 19
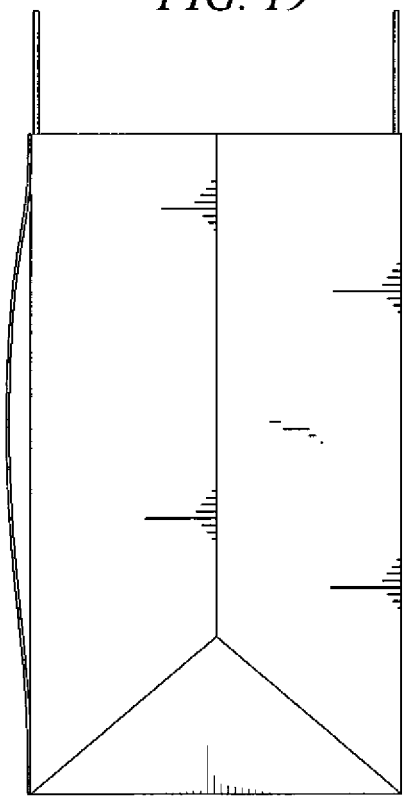

SECURABLE CONSUMER GOODS TRANSPORTATION APPARATUS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND

For consumers, transporting consumer goods from one location to another can prove problematic. In particular, consumable items such as food may need to be transported from a commercial establishment such a restaurant to a consumer's home. The consumer may place these items into a disposable bag, and then place the bag into a vehicle. One of the problems that this creates is that if a driver makes a sudden stop, then the items in the disposable bag may spill. If the consumable items are in the liquid form, such as a soup, then this can permanently damage upholstery within the vehicle.

SUMMARY

In one aspect, the disclosure includes a securable consumer goods transportation apparatus comprising a container, and a spill prevention strap attached to the container.

In another aspect, the disclosure includes a method comprising placing a consumer good in a container comprising a spill retention strap, positioning the container in a vehicle, securing the container in the vehicle using the spill retention strap, wherein the spill retention strap substantially maintains the position of the container relative to the vehicle when the vehicle experiences a substantially sudden movement.

In a third aspect, the disclosure includes a method comprising providing instructions to secure a container comprising a spill retention strap in a vehicle, wherein the spill retention strap substantially maintains the position of the container relative to the vehicle when the vehicle experiences a substantially sudden movement.

These and other features and advantages will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

FIG. 17 is a rear elevational view of a representative securable consumer goods transportation apparatus to which the instructional graphic is applied to a front surface thereof.

FIG. 18 is a left side elevational view of a representative securable consumer goods transportation apparatus to which the instructional graphic is applied to a front surface thereof.

FIG. 19 is a right side elevational view of a representative securable consumer goods transportation apparatus to which the instructional graphic is applied to a front surface thereof.

DETAILED DESCRIPTION

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Disclosed herein is a securable consumer goods transportation apparatus that may be used to secure consumer goods inside of a vehicle. Specifically, the securable consumer goods transportation apparatus may comprise a container, such as a box or sack, that includes a spill prevention strap on at least one surface. The spill prevention strap allows a user to secure the securable consumer goods transportation apparatus inside of the vehicle using a securement device, such as a seatbelt. When the vehicle makes a sudden movement, such as rapid lane change or deceleration, the spill prevention strap retains the securable consumer goods transportation apparatus, and hence the consumer goods contained therein, in its position relative to the vehicle, rather than allowing the inertia of the container and/or consumer goods to move the securable consumer goods transportation apparatus relative to the vehicle and perhaps spill the consumer goods. As such, the user is able to retain the consumer goods in the securable consumer goods transportation apparatus in a vehicle during transit between locations.

Figure 1A:
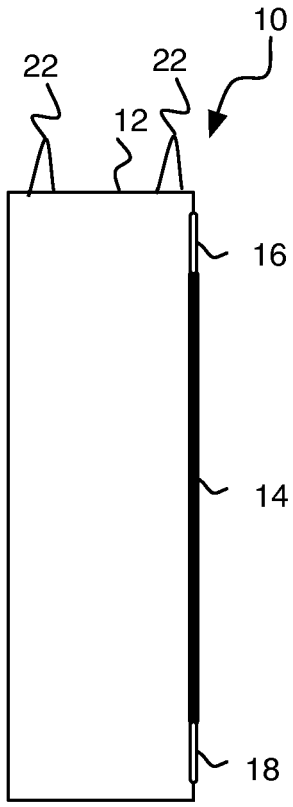
FIG. 1A is a side view of an embodiment of a securable consumer goods transportation apparatus.
Figure 1B:
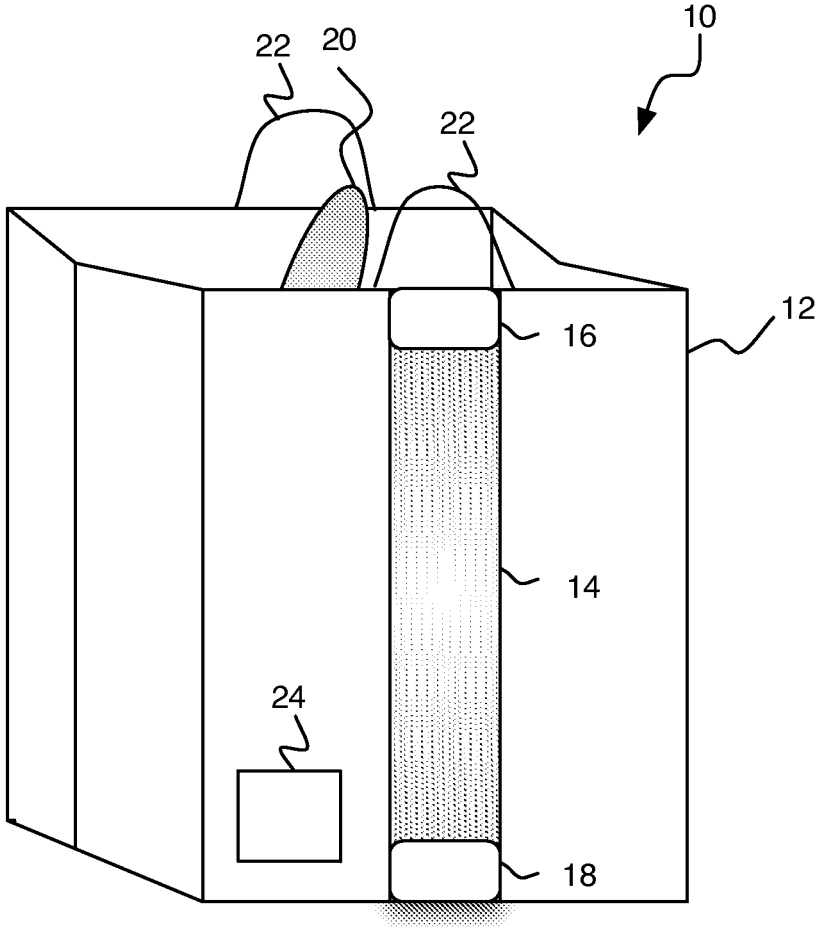
FIG. 1B is a perspective view of the embodiment of the securable consumer goods transportation apparatus illustrated in FIG. 1A.

FIGS. 1A and 1B illustrate side and perspective views of an embodiment of a securable consumer goods transportation apparatus 10. The securable consumer goods transportation apparatus 10 may include a container 12 and a spill prevention strap 14 attached to the container 12 at a first connection point 16 and a second connection point 18. At least one side, e.g. the top, of the container 12 may be open or openable so as to permit consumer goods 20 to be stored within securable consumer goods transportation apparatus 10. In addition, one or more handles 22 may be attached to the container 12 to facilitate movement of the securable consumer goods transportation apparatus 10.

The container 12 may be any apparatus or device suitable for transporting consumer goods 20. For example, the container 12 may be a box, crate, sack, bag, tote, or similar apparatus made of plastic, paper, cloth, or any other suitable material. The container 12 may be sized to accommodate a specific type of consumer goods 20, such as groceries, restaurant take-out food, and the like. In some embodiments, the container 12 may be a hexahedron, which is a three-dimensional, six-sided object that resembles a cube when all faces are of equal dimensions or a box when not all faces are of equal dimensions. One or more sides may have at least one pleat to promote the folding or collapse of the container 12. The pleats may be separate faces or subparts of a larger face. In addition, at least one side of the container 12 may be open, as is the case with a grocery bag or a box lacking a top. Alternatively, at least one side of the container 12 may be configured with a lid, door, panel, closure, or similar device that may be opened to permit access into the interior of the container 12 or closed and optionally secured in place to deny access into the interior of the container 12. In addition, the container 12 may contain one or more internal partitions to allow the consumer goods 20 to be organized, separated, and/or more securely stored therein. Finally, the container 12 may contain any amount and configuration of reinforcing structures as deemed necessary. For example, reinforcing structures may be desired where the handles 22 and/or spill prevention strap 14 attach to the container. In an embodiment, the container comprises a pre-folded sack made of a heavy gauge paper that may be unfolded and opened at a store or restaurant and filled with consumer goods for transport. Examples of such heavy gauge paper include 1.5, 1.75, and 2.0 gauge, and such paper may be further coated for example with wax or paraffin to aid in containing the consumer goods, for example to aid in moisture resistance caused by condensation from hot or cold items. Examples of suitable sizes for container 12 include about 5.25×3.25×13, about 8×5×10, about 10×6×13, about 12×9×16, about 13×7×13, about 13×8×17, about 14.5×9×16, with dimensions of width, depth, and height in inches. In an embodiment, the container is a paper twine handle restaurant sack, a restaurant paper shopper, a restaurant carryout bag, a restaurant bag, a kraft shopping bag, a shopping tote, a Euro-tote, ribbon handle totes, rope handles totes, twill handle totes, rope handle shopping bags, jute totes, and Tokyo totes, as such terms are used by those skilled in the art.

In an embodiment, the securable consumer goods transportation apparatus 10 includes the spill prevention strap 14. The spill prevention strap 14 may be attached to the container 12 across the entire length of one face of the container 12 or across less than the entire length of a face. For example, FIGS. 1A and 1B illustrate the spill prevention strap 14 across substantially the entire length of the front face, e.g. from the first connection point 16 at the top of the container to the second connection point 18 at the bottom of the container. Alternatively, the spill prevention strap 14 may be attached to different faces of the container 12, such as a front face and a side face. Further, the spill prevention strap 14 may be attached to the container 12 at a single connection point such that one or more loops are formed by the spill prevention strap 14. The spill prevention strap 14 may be attached onto the container 12 using various attachment means, including adhesive, glue, cement, hook-and-loop tape such as Velcro®, buttons, snaps, stitching, staples, rivets, peel and stick attachments, or any other attachment means known to persons of ordinary skill in the art. Finally, the spill prevention strap 14 may be sized and attachment means chosen depending on the intended consumer goods 20 that the securable consumer goods transportation apparatus 10 will carry. For example, the spill prevention strap 14 may be about three inches wide and sealed by an adhesive that is used in an area approximately one inch by three inches at both the first connection point 16 and second connection point 18 when the securable consumer goods transportation apparatus 10 is configured to transport restaurant take-out containers. In an embodiment, the width of the spill prevention strap 14 is in a range of from about 5% to about 50% of the width of the container (e.g., the width of the face upon which the spill prevention strap 14 is disposed), alternatively from about 10% to about 40%, alternatively from about 10% to about 30%, alternatively from about 15% to about 25%, alternatively from about 20% to 25%.

The securable consumer goods transportation apparatus 10 may also include at least one handle 22. For example, a single handle 22 may be attached to one face of the container 12 or may be attached to a plurality of faces of the container 12. Alternatively, the securable consumer goods transportation apparatus 10 may contain a plurality of such handles 22. The handles 22 may be integral with the container 12 or may be a separate article or device attached to the container 12. In a specific embodiment, the handles 22 and the spill prevention strap 14 are a single entity in that the handle may be used to transport the securable consumer goods transportation apparatus 10 in a first position, and then used to secure the securable consumer goods transportation apparatus 10 in a second position. Although the first position and the second position may be substantially the same, it is contemplated that the first position will generally be substantially upright, while the second position is substantially downward. In another embodiment, the handles 22 and the spill prevention strap 14 are a single entity wherein the spill prevention strap extends upward from the first connection point 16 and loops over the top of container 12 and is attached at one or more attachment points on an opposite face of the container 12. For example, a single spill prevention strap 14 may loop over the container 12 and attach at first connection points 16 on opposing faces of the bag near the top opening and attach at second connection points 18 on opposing faces of the bag near the bottom edges.

In an embodiment, the consumer goods transportation apparatus 10 may include at least one set of instructions 24. The instructions may inform the user of the details regarding installation of the consumer goods transportation apparatus 10 in the vehicle. In an embodiment, the instructions 24 may be a graphic or an illustration depicting the proper securement of the consumer goods transportation apparatus 10 in the vehicle, as explained in detail below. An example of such an illustration is shown in FIG. 1 as instructions 24. Alternatively, the instructions may be printed separately and provided to the user with the consumer goods transportation apparatus 10. The instructions 24 may also contain written instructions in one or more languages, such as English, Spanish, Chinese, German, French, Japanese, Korean, Russian, or any other language. Finally, someone familiar with the installation of the consumer goods transportation apparatus 10 in a vehicle may instruct the user how to install the consumer goods transportation apparatus 10 in the vehicle.

Figure 2:
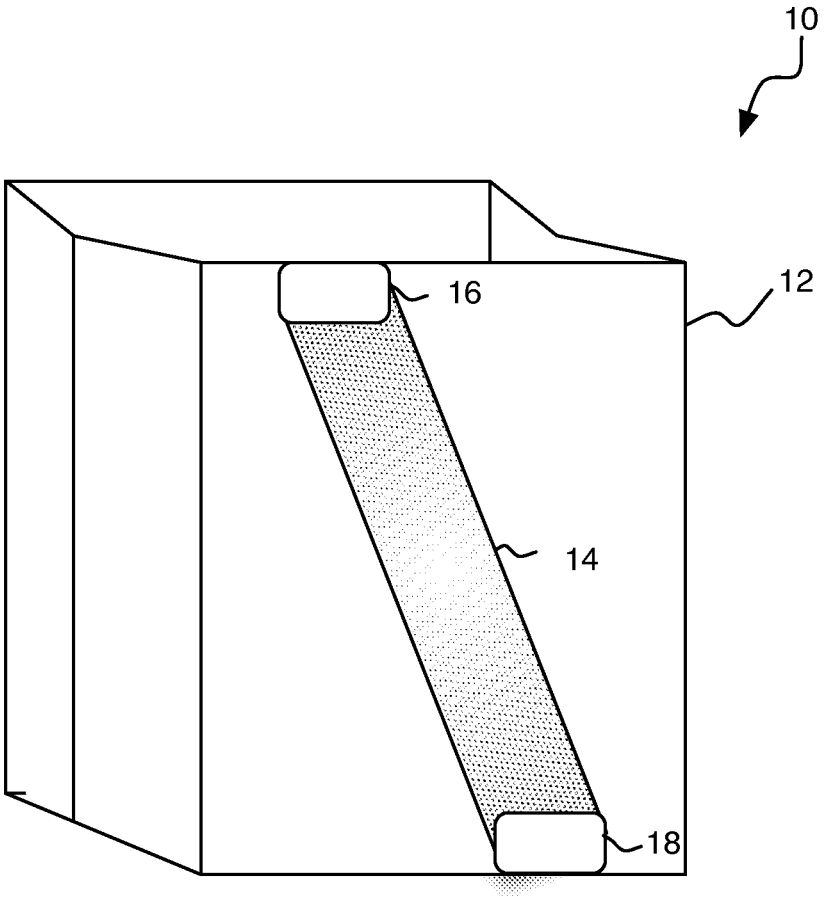
FIG. 2 is a perspective view of another embodiment of the securable consumer goods transportation apparatus.

The spill prevention strap 14 may be oriented in any direction with regards to the container. For example, the spill prevention strap 14 may be oriented substantially vertical, substantially horizontal, or at an angle, such as about 15, about 30, about 45, about 60, or about 75 degrees with respect to the horizontal. FIG. 2 illustrates an embodiment of the securable consumer goods transportation apparatus 10 where the spill prevention strap 14 is oriented at an angle on the container 12. Such an embodiment may improve the ease in which the securable consumer goods transportation apparatus 10 is secured in the vehicle, particularly when the securement device is also at an angle, as is the case with shoulder seatbelts in most vehicles. In an embodiment, the angle of the spill prevention strap 14 is opposite the angle of a vehicle seatbelt to further aid in securing the consumer goods transportation apparatus 10 in the vehicle.

Figure 3A:
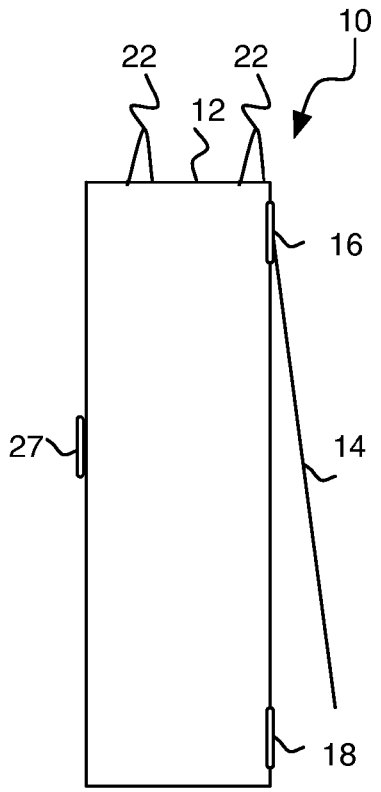
FIG. 3A is a side view of another embodiment of the securable consumer goods transportation apparatus.
Figure 3B:
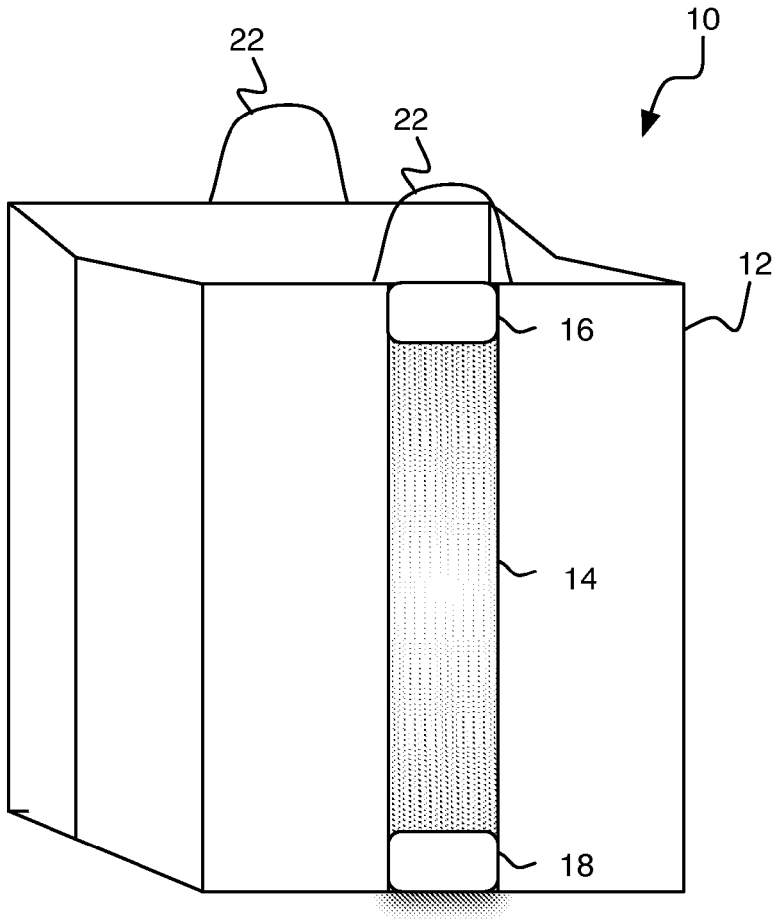
FIG. 3B is a perspective view of the embodiment of the securable consumer goods transportation apparatus illustrated in FIG. 3A.

In an embodiment, the spill prevention strap 14 may be semi-permanently attached to the container 12 in at least one location, as shown in FIGS. 3A and 3B. In such an embodiment, the securable consumer goods transportation apparatus 10 may be configured with a spill prevention strap 14 that is permanently attached to the container 12 at the first connection point 16, but is semi-permanently attached to the container 12 at the second connection point 18. In an embodiment, a second, semi-permanent attachment point 27 is disposed on the opposite side contain 12, thereby allowing the semi-permanent attachment end of spill prevention strap 14 to be looped over the top of the container 12 and semi-permanently attached to the second connection point 27 and forming a carrying handle for container 12. Any semi-permanent attachment means may be used such as hook and loop fasteners (e.g., Velcro). Alternatively, the securable consumer goods transportation apparatus 10 may be configured with a spill prevention strap 14 that is semi-permanently attached to the container 12 at the first connection point 16 and permanently attached to the container 12 at the second connection point 18, or semi-permanently attached to the container 12 at both the first connection point 16 and the second connection point 18. In such embodiments, the semi-permanent attachment may be a fully removable attachment means, such as a button, snap, hook-and-loop tape, or the like. In such fully removable attachment means embodiments, a third semi-permanent attachment point (e.g., point 27) may again be included on the an opposing face of the bag, thereby allowing the semi-permanent attachment end of spill prevention strap 14 to be looped over the top of the container 12 and semi-permanently attached to the second connection point 27 and forming a carrying handle for container 12. The semi-permanent attachment points 16, 18, and 27 may be spaced to provide an appropriate length handle formed from the semi-permanent attachment of spill prevention strap 14 thereto. Alternatively, the semi-permanent attachment may be a one-time use attachment means, such as a pre-applied adhesive that is exposed by removing a plastic covering, e.g. a peel-and-stick type adhesive, or a moisture-activated adhesive similar to that found on envelopes and stamps. Such embodiments allow the spill prevention strap 14 to be connected or disconnected from the container 12 prior to securement within the vehicle, which may aid in securement of the securable consumer goods transportation apparatus 10 within the vehicle.

Figure 4A:
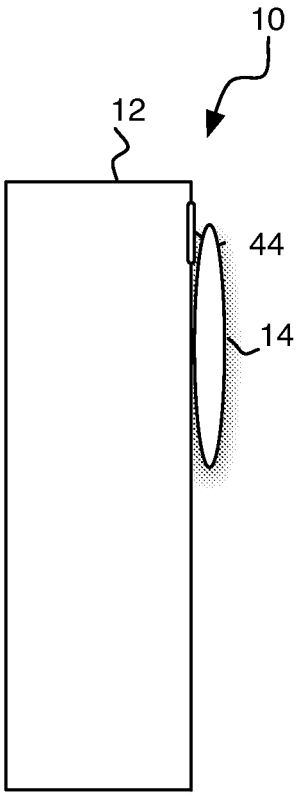
FIG. 4A is a side view of another embodiment of the securable consumer goods transportation apparatus.
Figure 4B:
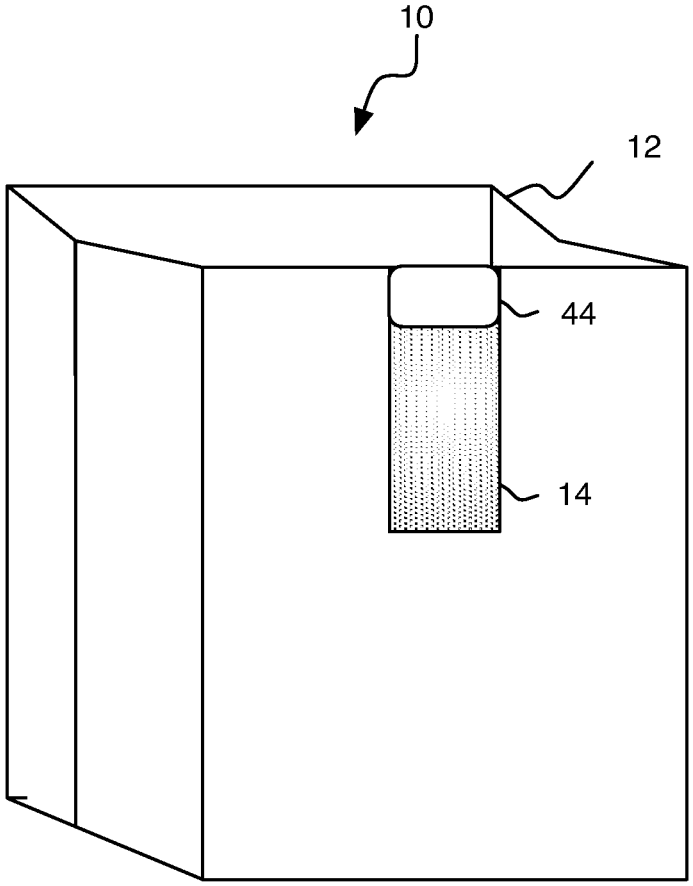
FIG. 4B is a perspective view of the embodiment of the securable consumer goods transportation apparatus illustrated in FIG. 4A.

In an embodiment, the spill prevention strap 14 may be attached to the container 12 at a single attachment point 44, as shown in FIGS. 4A and 4B. In such an embodiment, the spill prevention strap 14 may be in the form of a loop that may be sized as appropriate to allow the securable consumer goods transportation apparatus 10 to be maintained in a position relative to the vehicle when the vehicle moves. The single attachment point 44 may be a permanent or semi-permanent attachment, both of which are described above. Alternatively, the single attachment point 44 may be a combination of a permanent and semi-permanent attachment such that one part of the spill prevention strap 14 is permanently attached to the container 12, but another part of the spill prevention strap 14 is attached to itself using a semi-permanent attachment. Such embodiments allow the spill prevention strap 14 to be opened and closed prior to securement within the vehicle, which may aid in the securement of the securable consumer goods transportation apparatus 10 within the vehicle. Furthermore, the semi-permanent attachment end of the strap may be looped over the top of the container 12, and semi-permanently attached to a semi-permanent attachment point (e.g., point 27) on the an opposing face of the bag, thereby forming a carrying handle for container 12.

Figure 5A:
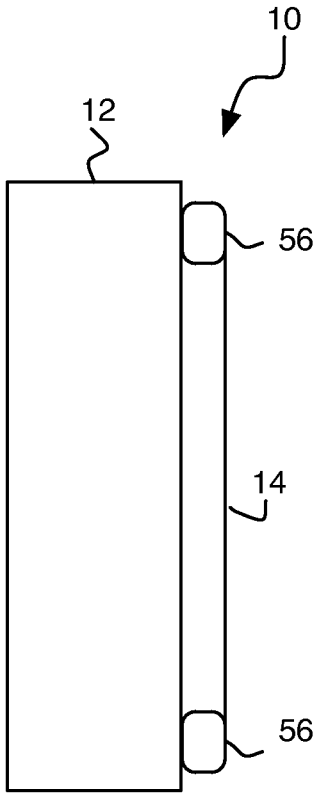
FIG. 5A is a side view of another embodiment of the securable consumer goods transportation apparatus.
Figure 5B:
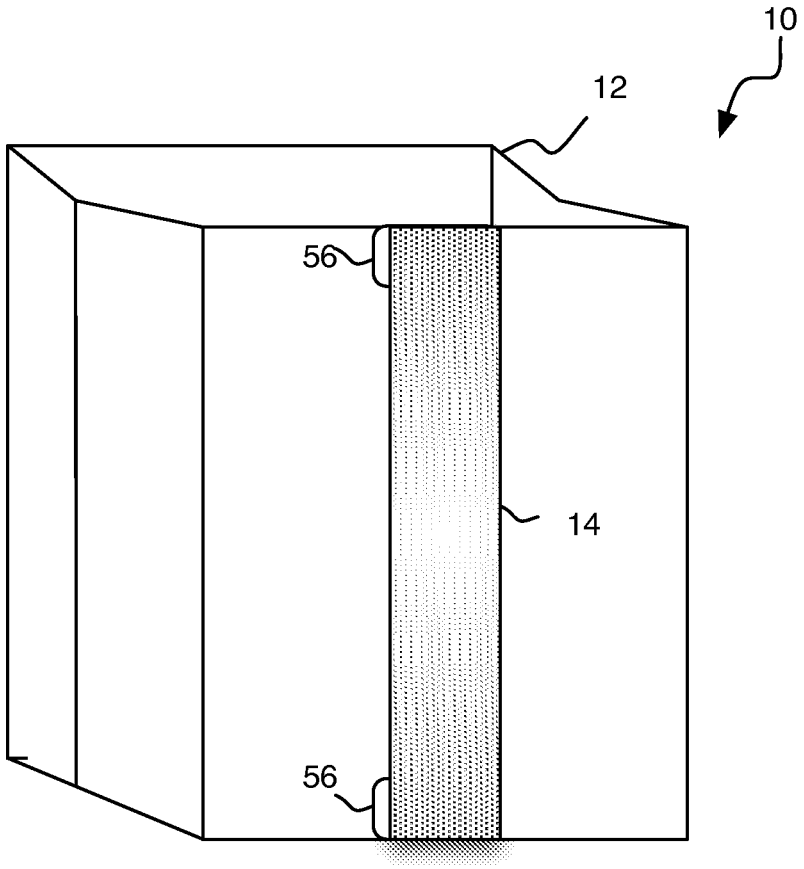
FIG. 5B is a perspective view of the embodiment of the securable consumer goods transportation apparatus illustrated in FIG. 5A.

In an embodiment, the spill prevention strap 14 may be attached to the container 12 via one or more spacers 56, as shown in FIGS. 5A and 5B. The spacers 56 create additional room between the container 12 and the spill prevention strap 14, thereby allowing a relatively large or thick securement device to pass between spill prevention strap 14 and securable consumer goods transportation apparatus 10 and easing the securement of the securable consumer goods transportation apparatus 10 within the vehicle. The spacers 56 may be attached to the container 12 and the spill prevention strap 14 using any of the permanent and/or semi-permanent attachment means described herein, and may be combined with any of the concepts illustrated in FIGS. 1A, 1B, 2, 3A, 3B, 4A, and 4B.

Figure 6:
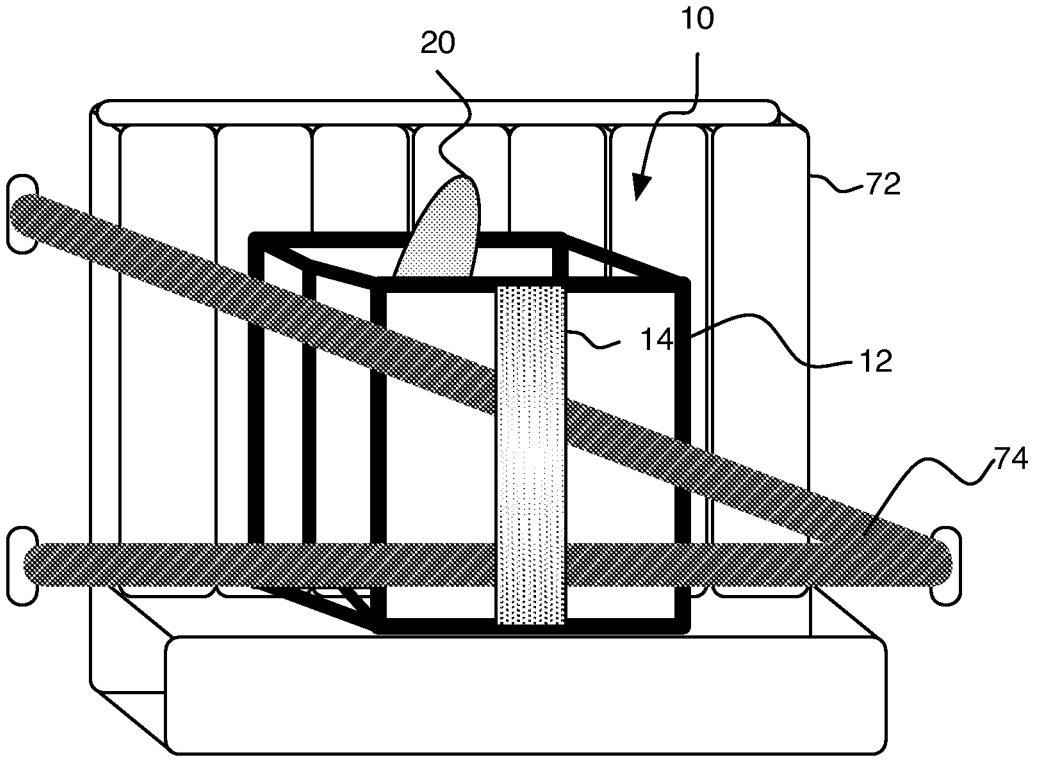
FIG. 6 is a perspective view of one embodiment of the securable consumer goods transportation apparatus on a stabilizing surface.

FIG. 6 illustrates the securable consumer goods transportation apparatus 10 secured on a stabilizing surface 72. The stabilizing surface 72 may be a chair, seat, car seat, floorboard, trunk, or any other object that may support securable consumer goods transportation apparatus 10 in the vehicle. For the purposes described herein, the vehicle may be a car, truck, recreational vehicle, motorcycle, bicycle, boat, aircraft, or any other vehicle. The stabilizing surface 72 may be an integral part of a vehicle, such as a seat or floorboard, or may be a component that has been added to a vehicle, such as an infant or child safety seat. In an embodiment, the stabilizing surface 72 supports the securable consumer goods transportation apparatus 10 on at least two of its faces (e.g., the back and bottom of the container 12).

FIG. 6 also illustrates an embodiment in which a restraining belt 74 is the securement device used to secure the securable consumer goods transportation apparatus to the stabilizing surface 72. The restraining belt 74 may be any belt or strip configured to secure the securable consumer goods transportation apparatus to the stabilizing surface 72, such as a seatbelt, strap, rope, cord, webbing, and the like. The restraining belt 74 may be a combination lap and shoulder belt as shown in FIGS. 6, 7, 8, and 9, or the restraining belt 74 may be either a lap belt or a shoulder belt. To secure the securable consumer goods transportation apparatus 10 in place, the restraining belt 74 may be inserted through the spill prevention strap 14 such that the restraining belt 74 is between the spill prevention strap 14 and the container 12. If the spill prevention strap 14 is implemented as a loop, as shown in FIGS. 4A and 4B above, the restraining belt 74 may be inserted through the loop of the spill prevention strap 14 to secure the securable consumer goods transportation apparatus 10 in place.

Alternatively, the securable consumer goods transportation apparatus may be secured to the stabilizing surface 72 using securement device other than the restraining belt 74. For example, other portions of the vehicle may be used as securement device by positioning those portions of the vehicle between the spill prevention strap 14 and the container 12 to secure the securable consumer goods transportation apparatus in place. Examples of such portions of the vehicle include various door or other handles, car seats, head rests, shift knobs, and the like. In many embodiments, the spill prevention strap 14 will need to be configured with at least one semi-permanent attachment to allow the securable consumer goods transportation apparatus to be secured with such alternative securement device.

The securable consumer goods transportation apparatus 10 may be oriented in any direction with respect to the stabilizing surface 72. For example, FIG. 6 illustrates securable consumer goods transportation apparatus 10 with the spill prevention strap 14 facing forward. However, it is contemplated that the securable consumer goods transportation apparatus 10 may be oriented in other directions as well. Specifically, the securable consumer goods transportation apparatus 10 may be oriented such that the spill prevention strap 14 faces left, right, up, down, or backwards, so long as the spill prevention strap 14 is sufficiently accessible to be used to secure the securable consumer goods transportation apparatus 10 within the vehicle.

Figure 7:
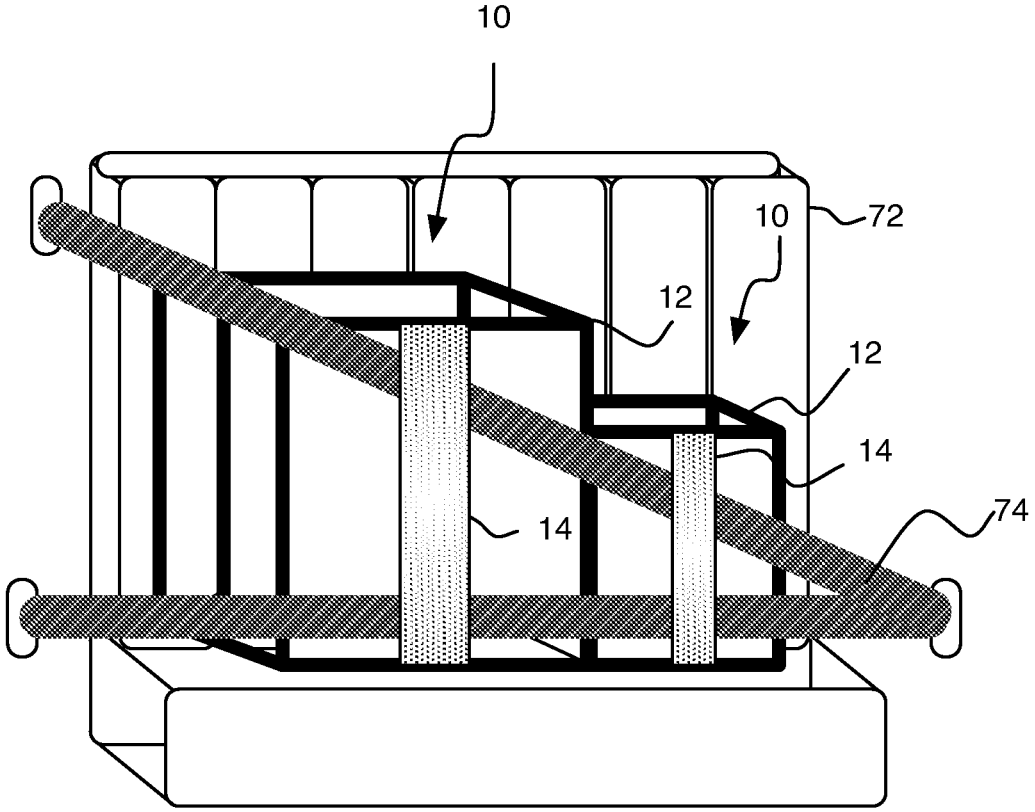
FIG. 7 is a perspective view of another embodiment of two securable consumer goods transportation apparatuses on a stabilizing surface.

FIG. 7 illustrates a plurality of the securable consumer goods transportation apparatuses 10 secured to a single stabilizing surface 72. Although any number of securable consumer goods transportation apparatuses 10 may be used, FIG. 7 illustrates two securable consumer goods transportation apparatuses 10 positioned substantially adjacent to one another on a single stabilizing surface 72 and secured with a single restraining strap 74. Persons of ordinary skill in the art will appreciate that the plural securable consumer goods transportation apparatuses may be secured to the stabilizing surface 72 using different securement devices, such as two separate restraining straps 74 or a single restraining strap 74 and another one of the alternative securement device described herein.

When a plurality of securable consumer goods transportation apparatuses 10 are used in a single vehicle, the securable consumer goods transportation apparatuses 10 may be any combination of size and configuration. As used herein, the term "size" refers to the physical dimensions of the securable consumer goods transportation apparatuses 10, which may be dictated predominantly by the container 12. In contrast, the term "configuration" refers to the features of the securable consumer goods transportation apparatuses 10 other than size. For example, the orientation of the spill prevention strap 14, the presence of handles 22, the type of attachment means used, e.g. permanent or semipermanent, and similar such features affect the configuration of the securable consumer goods transportation apparatuses 10. FIG. 7 illustrates two securable consumer goods transportation apparatuses 10 with different sizes but the same configuration. However, persons of ordinary skill in the art will appreciate that the plural securable consumer goods transportation apparatuses 10 may be the same size and configuration, different sizes and configurations, or the same size but different configurations.

Figure 8:
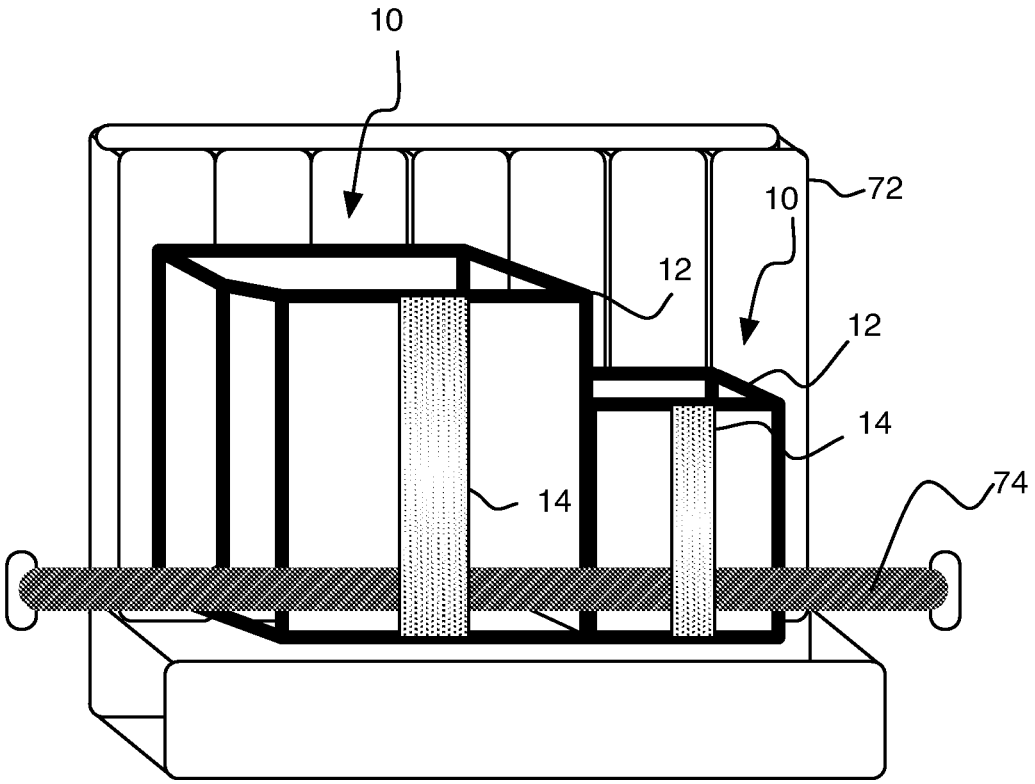
FIG. 8 is a perspective view of another embodiment of two securable consumer goods transportation apparatuses on a stabilizing surface.
Figure 9:
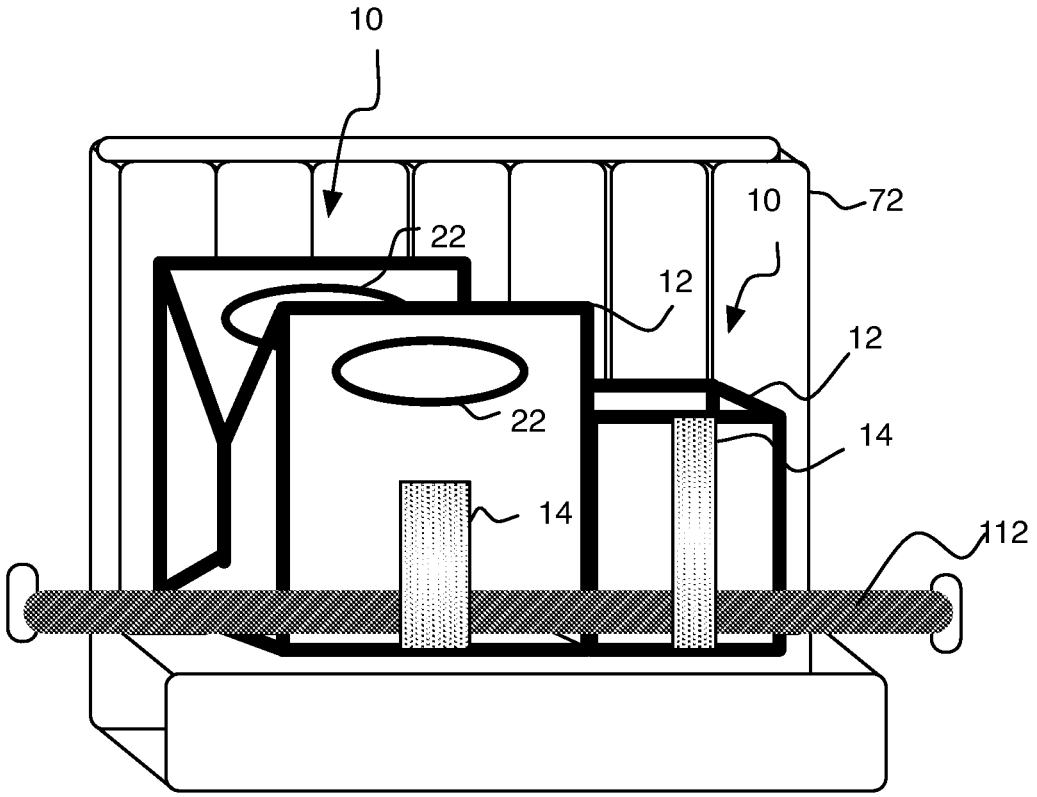
FIG. 9 is a perspective view of another embodiment of two securable consumer goods transportation apparatuses on a stabilizing surface.

FIGS. 8 and 9 illustrate alternative configurations of a plurality of the securable consumer goods transportation apparatuses 10 secured to the stabilizing surface 72. Specifically, FIG. 8 illustrates the securable consumer goods transportation apparatuses 10 secured to the stabilizing surface 72 using the single lap belt embodiment of the restraining strap 74. Similar to FIG. 7, the securable consumer goods transportation apparatuses 10 in FIG. 8 are the same configuration, but different sizes. Likewise, FIG. 9 illustrates the securable consumer goods transportation apparatuses 10 secured to the stabilizing surface 72 using the single lap belt embodiment of the restraining strap 74. In contrast to FIGS. 7 and 8, the securable consumer goods transportation apparatuses 10 in FIG. 9 are different configurations and different sizes. Specifically, one of the securable consumer goods transportation apparatuses 10 shown in FIG. 9 contains a plurality of handles 22, as well as a spill retention strap 14 that extends partially over the length of the container 12. As shown in FIG. 9, the handles 22 may be integral with the container 12 (e.g., cutouts or other openings, and optionally reinforced), may extend upward from container 22 as shown for example in FIG. 1, or may be formed from the spill prevention strap 14 (as described previously) when spill prevention strap 14 is not in use.

Figure 10:
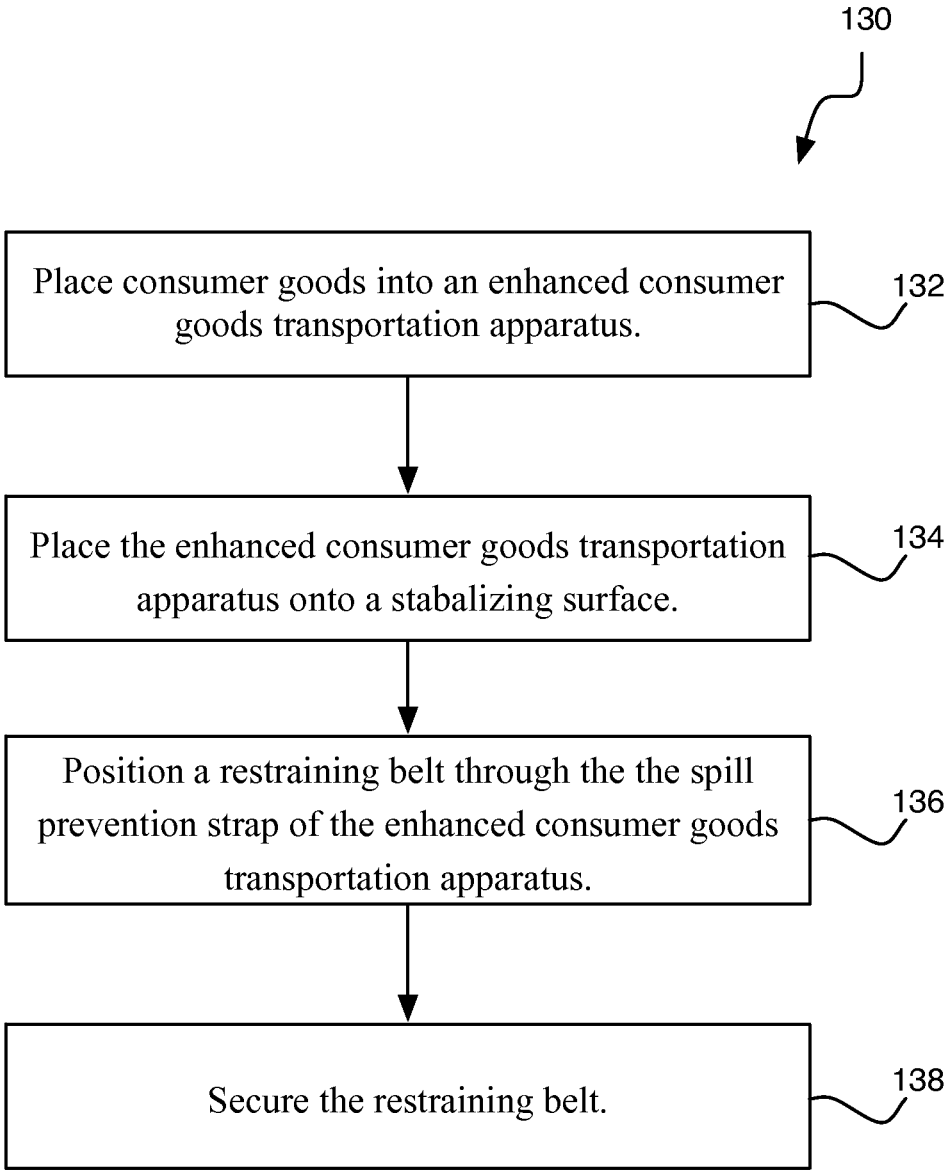
FIG. 10 is a flowchart of one method of using a securable consumer goods transportation apparatus.
Figure 11:
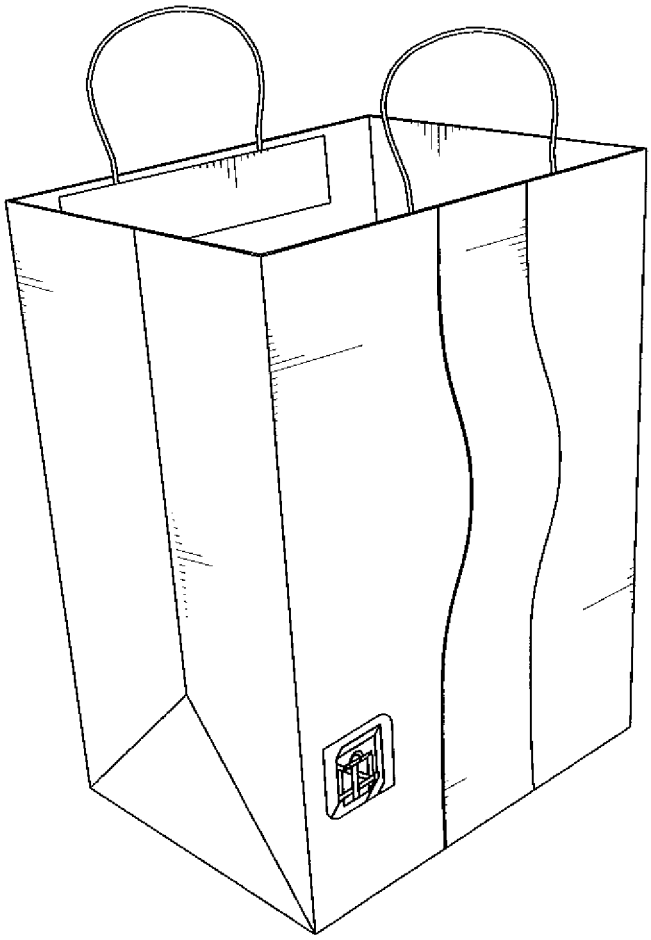
FIG. 11 is a perspective view of the front, side and top of a representative securable consumer goods transportation apparatus with an instructional graphic.

FIG. 10 is a flowchart of a method 130 for securing consumer goods using a securable consumer goods transportation apparatus. This method may begin by placing the consumer goods into the securable consumer goods transportation apparatus at 132. The method 130 may continue by placing the securable consumer goods transportation apparatus onto a stabilizing surface at 134. The method 130 may also include placing a restraining belt through the spill prevention strap on the securable consumer goods transportation apparatus at 136. The method 130 may conclude by securing the restraining belt at 138. Alternatively, blocks 138 and 136 may be reversed, wherein the restraining belt is first secured, and then the spill prevention strap in placed over the restraining belt and permanently (e.g., peel and stick) or semi-permanently (e.g., hook-and-loop) secured to the container 12, resulting in the restraining belt passing between the container and the spill prevention strap. Once the restraining belt is secured, the consumer goods may be retained in the securable consumer goods transportation apparatus when the vehicle makes a sudden move, such as a rapid acceleration, sideways motion, or deceleration.

Figure 12:
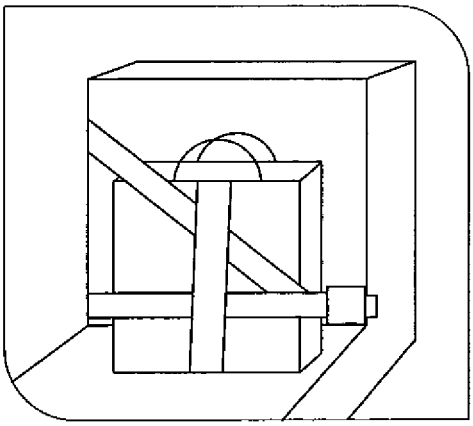
FIG. 12 is an enlarged front elevational view of the instructional graphic.
Figure 13:
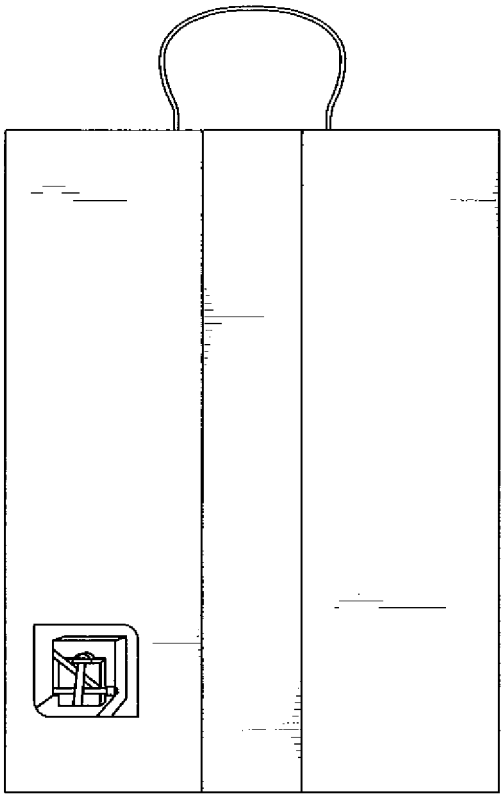
FIG. 13 is a front elevational view of the representative securable consumer goods transportation apparatus of FIG. 11 applied with the instructional graphic in approximately the lower left corner thereof.
Figure 14:
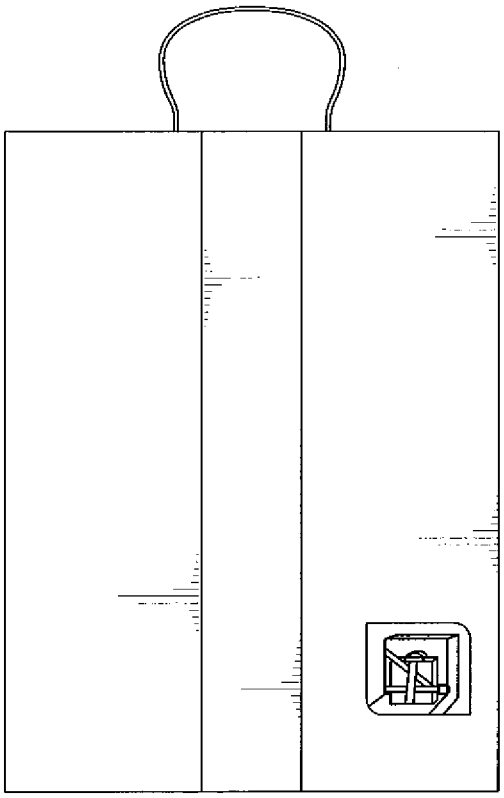
FIG. 14 is a front elevational view of a representative securable consumer goods transportation apparatus applied with the instructional graphic in approximately the lower right corner thereof.
Figure 15:
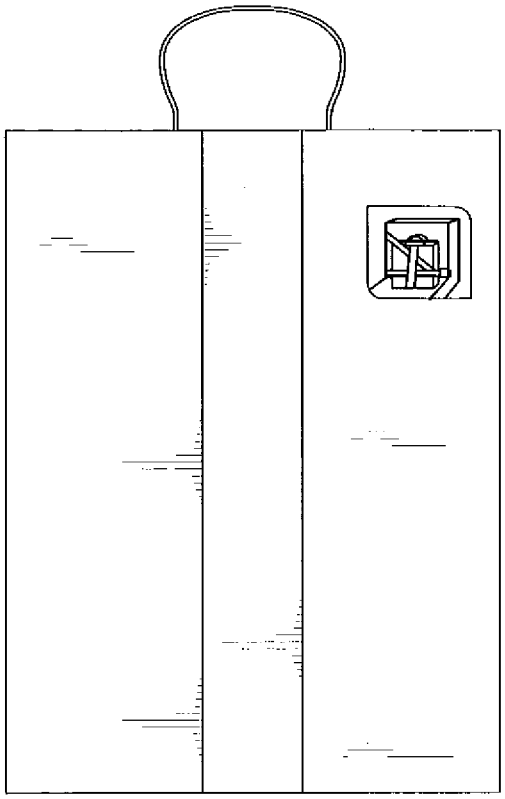
FIG. 15 is a front elevational view of a representative securable consumer goods transportation apparatus applied with the instructional graphic in approximately the upper right corner thereof.
Figure 16:
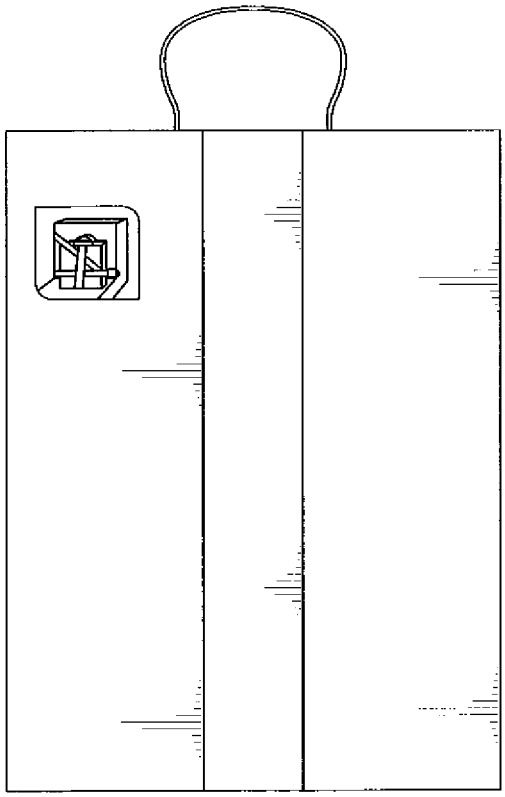
FIG. 16 is a front elevational view of a representative securable consumer goods transportation apparatus applied with the instructional graphic in approximately the upper left corner thereof.
Figure 20:
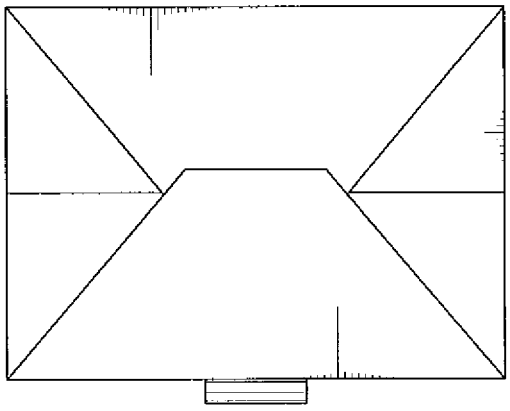
FIG. 20 is a bottom plan view of a representative securable consumer goods transportation apparatus to which the instructional graphic is applied to a front surface thereof.
Figure 21:
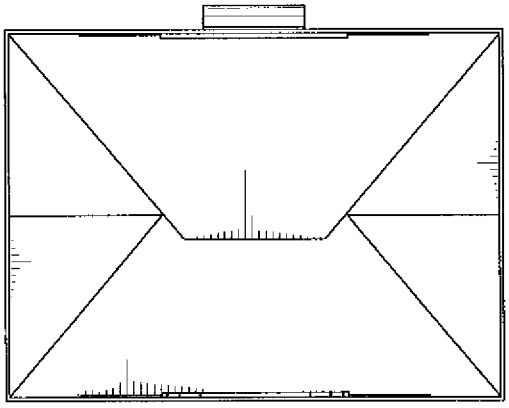
FIG. 21 is a top plan view of a representative securable consumer goods transportation apparatus to which the instructional graphic is applied to a front surface thereof.
Figure 10:
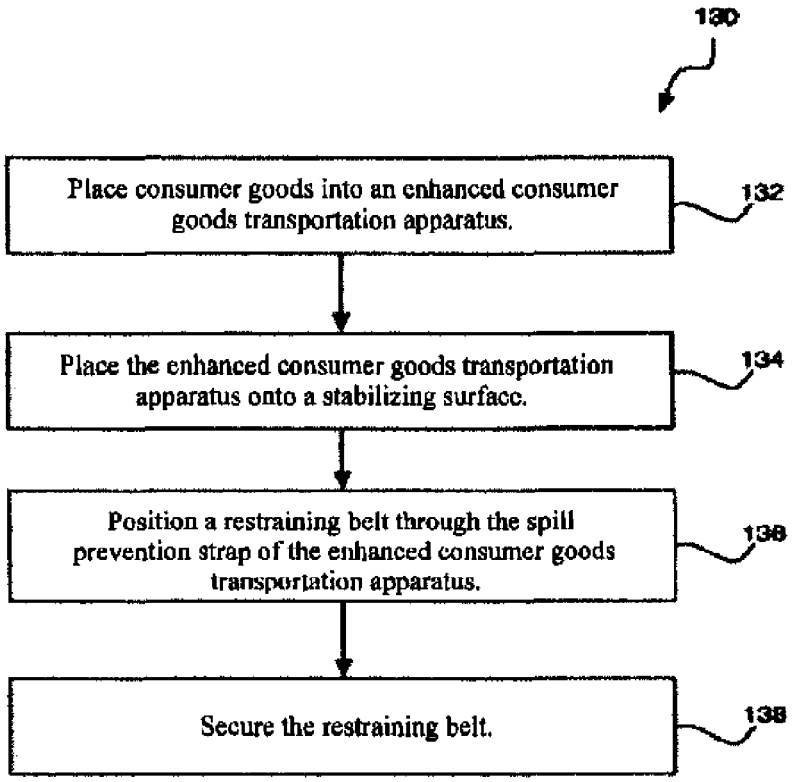

FIGS. 11-21 are various views of an embodiment of a securable consumer goods transportation apparatus in accordance with the present disclosure, for example a restaurant or food products carry out bag. FIG. 12 is a view of an embodiment of instructions 24 represented as a graphic illustration of the securable consumer goods transportation apparatus secured in a vehicle seat via a shoulder seat belt strap. FIGS. 13-16 show different locations for instructions 24.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The disclosures of all patents, patent applications, and publications cited herein are hereby incorporated by reference, to the extent that they provide exemplary, procedural, or other details supplementary to those set forth herein.

What is claimed is:

1. A method comprising:

using a container to accommodate consumer goods, wherein the container comprises a single spill retention strap, wherein the spill retention strap is permanently attached to the container at only one point and/or is semi-permanently attached to the container, and wherein, when the semi-permanent attachment is used, the semi-permanent attachment is configured for opening and closing prior to securing the container;

positioning the container in a vehicle;

securing the container in the vehicle using the spill retention strap, wherein the spill retention strap substantially maintains the position of the container relative to the vehicle when the vehicle experiences a substantially sudden movement.

2. The method of claim 1, wherein the consumer goods comprises one or more of groceries or restaurant take-out food.

3. The method of claim 1, wherein positioning the container in the vehicle comprises setting the container on a car seat.

4. The method of claim 1, wherein securing the container comprises passing a securement device between the container and the spill retention strap.

5. The method of claim 4, wherein the securement device is a seatbelt.

6. The method of claim 1, wherein the spill retention strap is in the form of a loop, and wherein securing the container comprises passing a securement device through the spill retention strap.

7. The method of claim 1, wherein positioning the container comprises positioning the container substantially adjacent to a second container comprising a second spill retention strap, and wherein securing the container comprises using a single securement device to secure the first container and the second container.

8. The method of claim 7, wherein the first container and the second container have different configurations, different sizes, or both.

9. The method of claim 7, wherein the first container and the second container have substantially identical configurations and substantially identical sizes.

10. The method of claim 1, wherein securing the container comprises positioning a restraining belt around the container and configuring the spill retention strap such that the restraining belt uses the container, the spill retention strap, or both to maintain the position of the container relative to the vehicle when the vehicle experiences a substantially sudden movement.

11. The method of claim 1, wherein the container comprises a handle.

12. The method of claim 1, wherein the container comprises instructions.

13. The method of claim 12, wherein the instructions are printed on the container or spill retention strap.

14. The method of claim 12, wherein the instructions comprise instructing a vehicle operator how to install the container.

15. The method of claim 1, wherein the spill retention strap is configured to receive a securement device and maintain the container in a position relative to the vehicle when the vehicle is in motion.

16. The method of claim 1, wherein the spill retention strap is attached to the container at only one location.

17. The method of claim 1, wherein the spill retention strap is semi-permanently attached to the container in at least one location.

18. The method of claim 1, wherein the container comprises a handle and instructions.

19. The method of claim 18, wherein the instructions are printed on the container or spill retention strap.

20. The method of claim 18, wherein the instructions comprise instructing a vehicle operator how to install the container in the vehicle.

* * * * *

UNITED STATES PATENT AND TRADEMARK OFFICE

CERTIFICATE OF CORRECTION

PATENT NO. : 9,227,768 B2
APPLICATION NO. : 11/861139
DATED : January 5, 2016
INVENTOR(S) : Eric S. Quick et al.

It is certified that error appears in the above-identified patent and that said Letters Patent is hereby corrected as shown below:

Drawings

Sheet 10 of 15, Fig. 10, boxes 134 and 136, replace with drawing on attached sheet Specification Col. 4, line 15, replace "handles totes," with --handle totes,--
Col. 5, line 55, replace "contain 12" with --of the container 12--
Col. 6, line 6, replace "on the an opposing" with --on the opposing--
Col. 6, line 45, replace "on the an opposing" with --on the opposing--

Signed and Sealed this
Nineteenth Day of April, 2016

Michelle K. Lee

Michelle K. Lee
*Director of the United States Patent and Trademark Office*